US011684863B1

(12) United States Patent
Soifer

(10) Patent No.: US 11,684,863 B1
(45) Date of Patent: Jun. 27, 2023

(54) SOFT AND SQUEEZABLE WATER PLAY TOY

(71) Applicant: Kids Squad LLC, Staten Island, NY (US)

(72) Inventor: Sara Soifer, Staten Island, NY (US)

( * ) Notice: Subject to any disclaimer, the term of this patent is extended or adjusted under 35 U.S.C. 154(b) by 0 days.

(21) Appl. No.: 18/100,718

(22) Filed: Jan. 24, 2023

(51) Int. Cl.
*A63H 23/10* (2006.01)
*A63H 23/00* (2006.01)

(52) U.S. Cl.
CPC ..... *A63H 23/10* (2013.01); *A63H 23/005* (2013.01)

(58) Field of Classification Search
CPC ..... A63H 23/00; A63H 23/005; A63H 23/10; G09B 23/12
See application file for complete search history.

(56) References Cited

U.S. PATENT DOCUMENTS 3,577,675 A * 5/1971 Kohner ..... A63H 23/10 446/199
3,665,638 A * 5/1972 Weistrop ..... A63H 23/10 446/166
3,844,283 A * 10/1974 Dabney ..... A61M 5/1411 604/246
5,336,122 A * 8/1994 Lewis ..... A63H 23/16 446/166
5,385,472 A * 1/1995 Mullin ..... G09B 25/025 446/166
6,561,810 B1 * 5/2003 Schellhardt ..... G09B 23/12 434/300
7,987,533 B2 * 8/2011 Phipps ..... E03C 1/0408 4/596
8,956,196 B2 * 2/2015 Rickenbach ..... A63H 23/10 446/153
10,556,188 B2 * 2/2020 Weisman ..... A63H 23/16
10,960,318 B2 * 3/2021 Sy ..... A63H 23/005
2006/0208101 A1 * 9/2006 DeBoer ..... A63H 23/10 239/16

* cited by examiner

*Primary Examiner* — John A Ricci

(57) ABSTRACT

A soft and squeezable bath toy set for young children for use in bathtubs and/or pools is disclosed. The bath toy set includes containers, each container having a body, an inlet and an outlet. Each container includes a mounting member for connecting the container to a wall. The bath toy set includes a T-shaped pipe, angled connecting pipes and a tube assembly. The tube assembly includes a tube holder holding tubes. The tube holder includes a tube mounting member for connecting the tube holder to the wall. The containers position in different configurations and the tube assembly positions underneath the containers. The T-shaped pipe or the angled connecting pipes interchangeably connect the outlet of the containers above, and the inlet of the containers or the tubes below. The containers at the top receive water through the inlet and water flows down via the outlet into the container or the tubes positioned underneath via the T-shaped pipe and/or the angled connecting pipes.

20 Claims, 8 Drawing Sheets

SOFT AND SQUEEZABLE WATER PLAY TOY

FIELD OF THE INVENTION

The present invention generally relates to toys. More particularly, the present invention relates to a soft and squeezable, easy to assemble bath toy set for young children for use in bathtubs and/or pools.

DESCRIPTION OF THE RELATED ART

It is known that bath toys are popular for children. The bath toys include, but not limited to, floating toys, balls, animal-shaped mitts, pipes, crayons, foam playing cards, plastic funnels, bulb-style basters, squeezing toys or sponges, measuring cups, measuring spoons, etc. The bath toys help the children to have fun during bath time and provide a great opportunity for learning and exploration.

Several bath toys have been disclosed in the past. One such example is disclosed in a United Stated granted U.S. Pat. No. 8,956,196, entitled "Mini-shower bath toy for single-handed adult use and double-handed child play" ("the '196 Patent"). The '196 Patent discloses a bath apparatus for play and/or bathing having a reservoir, a plurality of substantially co-planar bottom release holes, and a top control aperture. Upon submerging the bath toy, water flows into the reservoir through the release holes as air escapes through the control aperture. When the control aperture is sealed with a thumb or finger and the toy is raised from the water, water in the reservoir is retained in the reservoir. When the control aperture is unsealed, water in the reservoir flows out through the release holes. The control aperture is offset from the top of the reservoir by approximately 12° to be ergonomically located and oriented to allow a thumb to produce an airtight seal when the reservoir is held in a single adult-size hand, or to allow a finger to produce an airtight seal when the reservoir is held by child-size hands in both hands.

Another example is disclosed in a United Stated granted U.S. Pat. No. 10,960,318, entitled "Floatable toys" ("the '318 Patent"). The '318 Patent discloses a floatable toy, including a toy body and a skeleton. The toy body is provided with a receiving cavity and a first opening. The skeleton passes through the first opening and is located in the receiving cavity. The skeleton is provided with a first engaging portion on which a clamping groove is provided. The clamping groove is adapted to the first opening, and the toy body engages with the clamping groove in a snap fit through the first opening to fixedly connect the toy body and the skeleton, thereby sealing the receiving cavity. In this way, the toy body and the skeleton are connected and fixed in a detachable manner, the receiving cavity is opened or closed by the skeleton. Therefore, the interior of the floatable toy can be cleaned.

Yet another example is disclosed in a United Stated granted Patent No. 10,556,188, entitled "Water toy" ("the '188 Patent"). The '188 Patent discloses a bath toy system including a water play space delimiter arranged to be located in a water-filled bath and to define a water play space separate from a remainder of the water filled bath, a water spray assembly generating at least one water spray within the water play space and at least one floatable fanciful element floatable on the water within the water play space.

Although the above disclosures are useful, still there is a need in the art to provide improved bath toys suitable for children.

SUMMARY

It is one of the main objects of the present subject matter to provide a bath toy set and that avoids the drawbacks of the prior art.

It is another object of the present subject matter to provide a bath toy set for young children for use in bathtubs and/or pools that is soft, squeezable, and easy to assemble, disassemble and clean.

It is another object of the present subject matter to provide a bath toy set having containers of same or different size that can be arranged in various configurations to allow the children to have fun during bath time and provide a great opportunity for learning and exploration.

In order to overcome the limitations here stated, the present subject matter provides a bath toy set for young children for use in bathtubs and/or pools. The bath toy set includes a plurality of containers. The plurality of containers is made of soft and flexible material such as silicon or any other similar material. Each container comes in various shapes including bulb shapes or spherical or angular. As the containers are made of silicon material, they are squeezable. Each container includes a body, an inlet and an outlet. The said inlet extends from the top of the body. The outlet extends from near or at the bottom of the body. Each container includes a mounting member for connecting the container to a wall. The body includes an extended section connecting the mounting member. The mounting member includes one of a rubber pad, an adhesive pad, a suction cup, a clamp, and any combination thereof. The soft and squeezable containers are easy for children to assemble and disassemble. The container are also easy to clean and to drain of any water.

The bath toy set includes a plurality soft and squeezable of t-pipes and angled connecting pipes. Further, the bath toy set includes a tube assembly. The tube assembly includes a tube holder holding a plurality of tubes. The tube holder includes a tube mounting member for connecting the tube holder to the wall. The tube mounting member includes one of a rubber pad, an adhesive pad, a suction cup, a clamp, and any combination thereof. The soft and squeezable pipes, tubes, and tube assembly, are easy for children to assemble and disassemble and are also easy to clean and to drain of any water.

The plurality of containers position in parallel or over one another at an angle. The tube assembly positions underneath one or more containers of the plurality of containers. One of the T-shaped pipes and one or more angled connecting pipes of the plurality of angled connecting pipes interchangeably connect the outlet of a container of the plurality of containers and the inlet of a container of the plurality of containers or a tube of the plurality of tubes. One or more containers of the plurality of containers placed at the top receive water through the inlet and allows the water to flow down via the outlet and into the container or the tubes positioned underneath via the T-shaped pipe and the one or more angled connecting pipes of the plurality of angled connecting pipes.

In one implementation, the bath toy set includes a length extending pipe that connects the outlet to one of the inlets, the T-shaped pipe, and the plurality of angled connecting pipes. Further, the bath toy set may include an auxiliary container. Here, the auxiliary container indicates a container similar to the bulb-shaped containers having an inlet but without the outlet. The auxiliary container includes an auxiliary inlet that connects to one of the T-shaped pipe or an angled connecting pipe to receive water into the auxiliary container. The auxiliary container includes an auxiliary mounting member for connecting the auxiliary container to the wall. The auxiliary container may be filled and then rotated relative to the wall, to release water while mounted to the wall.

In one implementation, the squeezing of the container can send water out of the container in the opposite direction of gravity and add fun to the toy in a unique way.

In one implementation, a connecting pipe includes a connector or end cap or end member. The end member has a non-return value. The non-return value allows the squeezing of the container to send water in the opposite direction of gravity and add fun to the toy in a unique way.

Further, the bath toy set includes a mesh container for storing the plurality of containers, the T-shaped pipes, the angled connecting pipes, and the tube assembly when not in use. The mesh container includes a mesh mounting member (suction cup) for connecting the mesh container to the wall.

In one advantageous feature of the present invention, the containers come in the same or different sizes from one another. This allows the users to change the position of the containers and play with water during bath time. Further, the bath toy set helps the children to explore their curiosity for running water and/or use a liquid dispenser to have fun during their bath time.

In another advantageous feature of the present invention, the containers, the tube holder, the auxiliary container and the mesh container all have mounting members i.e., suction cups. The mounting members help to attach the containers, the tube holder, the auxiliary container and the mesh container via suction to the wall. As such, they are very easy to install and uninstall from the wall.

In another advantageous feature of the present invention, the containers, the tube holder, the auxiliary container are soft and flexible and therefore easier for children to assemble and disassemble.

In another advantageous feature of the present invention, the containers are made of soft and squeezable silicon material. As such, the user can squeeze the containers to generate bubbles by introducing soap in the water. Further, the containers can be cleaned easily.

In another advantageous feature of the present invention, the bath toy set can draw up and send down water via the pipes when facing upwards upon the user squeezing the containers.

In another advantageous feature of the present invention, the tubes mimic bubbling in a test tube when water falls into the tubes. Multiple tubes allow for some to collect water while others are removed from the assembly and used to pour water back into a container located above so the water can be go through the pipes and containers again. The flexible tubes such as the auxiliary container and the length extending pipes allow having more configurations. Optionally, the containers can be bent by the user for additional configurations. The containers can be used independently or together to form multiple runs and configurations. The bulb-shaped containers can be used for pouring in water, shaking water with soap to make bubbles and then pouring in or becoming part of the chain. Optionally, the user can use cards showing possible configuration instructions to form multiple configurations with the containers and the pipes/tubes.

In another advantageous feature of the present invention, the soft and flexible containers, tube assembly, and auxiliary container are not hurtful to children if they lose suction and fall off the wall, in the way a hard plastic toy might be.

In another advantageous feature of the present invention, the soft and flexible containers, tube assembly, and auxiliary container won't hurt children that have the bath toy throw at them when multiple children play with the toy at one time.

In another advantageous feature of the present invention, the soft and flexible containers, tube assembly, and auxiliary container are not dangerous for small children to place in their mouth or chew on the material.

In another advantageous feature of the present invention, the mesh container stores all the components of the bath toy set while being connected to the wall, saving space and allowing the bath toy set to dry.

Features and advantages of the subject matter hereof will become more apparent in light of the following detailed description of selected embodiments, as illustrated in the accompanying FIGUREs. As will be realized, the subject matter disclosed is capable of modifications in various respects, all without departing from the scope of the subject matter. Accordingly, the drawings and the description are to be regarded as illustrative in nature.

BRIEF DESCRIPTION OF THE DRAWINGS

With the above and other related objects in view, the subject matter consists in the details of construction and combination of parts as will be more fully understood from the following description, when read in conjunction with the accompanying drawings in which.

DESCRIPTION OF THE EMBODIMENTS OF THE INVENTION

Figure 1:
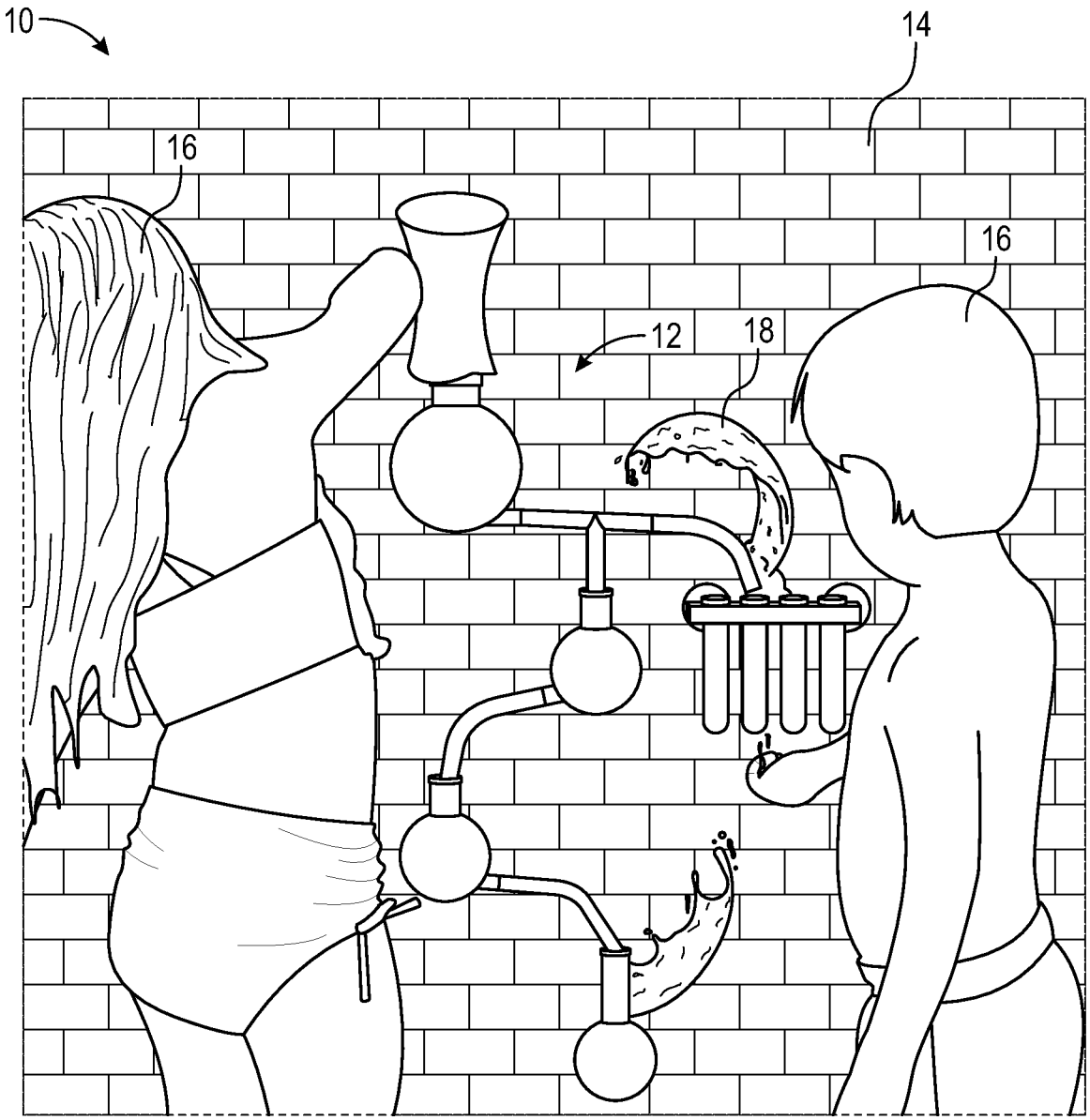
FIG. 1 illustrates an environment in which a bath toy set implements, in accordance with one embodiment of the present subject matter.

The following detailed description set forth below in connection with the appended drawings is intended as a description of exemplary embodiments in which the presently disclosed subject matter may be practiced. The term "exemplary" used throughout this description means "serving as an example, instance, or illustration," and should not necessarily be construed as preferred or advantageous over other embodiments. The detailed description includes specific details for providing a thorough understanding of the presently disclosed bath toy set. However, it will be apparent to those skilled in the art that the presently disclosed subject matter may be practiced without these specific details. In some instances, well-known structures and devices are shown in functional or conceptual diagram form in order to avoid obscuring the concepts of the presently disclosed bath toy set.

In the present specification, an embodiment showing a singular component should not be considered limiting. Rather, the subject matter preferably encompasses other embodiments including a plurality of the same component, and vice-versa, unless explicitly stated otherwise herein. Moreover, the applicant does not intend for any term in the specification to be ascribed an uncommon or special meaning unless explicitly set forth as such. Further, the present subject matter encompasses present and future known equivalents to the known components referred to herein by way of illustration.

Although the present subject matter provides a description of a bath toy set, it is to be further understood that numerous changes may arise in the details of the embodiments of the bath toy set. It is contemplated that all such changes and additional embodiments are within the spirit and true scope of this disclosure.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure.

The present subject matter discloses a bath toy set for young children for use in bathtubs and/or pools. The bath toy set includes containers in bulb-shape, each container having a body, an inlet and an outlet. Each container includes a mounting member for connecting the container to a wall. The bath toy set includes T-shaped pipes, angled connecting pipes and a tube assembly. The tube assembly includes a tube holder holding tubes. The tube holder includes a tube mounting member for connecting the tube holder to the wall. The containers position in parallel or over one another or at an angle, and the tube assembly may be positioned underneath the containers. One or more of the T-shaped pipe and one or more angled connecting pipes interchangeably connect the outlet of a container above and the inlet of the container or the tube below. The containers placed at the top receive water through the inlet and allow the water to flow down via the outlet and into the container or the tubes positioned underneath via the T-shaped pipe and the angled connecting pipes. Each container, pipe and tube can be made of soft flexible and squeezable material such as silicone or soft and flexible other material known in the art.

Various features and embodiments of a bath toy set are explained in conjunction with the description of FIGS. 1-16.

Referring to FIG. 1, an environment 10 in which a bath toy set 12 implements is shown, in accordance with one exemplary embodiment of the present subject matter. Bath toy set 12 connects to a wall 14 and allows users or children 16 to play with water 18 during their bath time in bathtubs, pools and the like. Here, users 16 may play with water 18 or water 18 mixed with soap depending on the need. For ease of explanation, water 18 is used in this description. However, it should include scope of using any liquid with or any other chemical solution to generate bubbles or any other desired effects.

Figure 2:
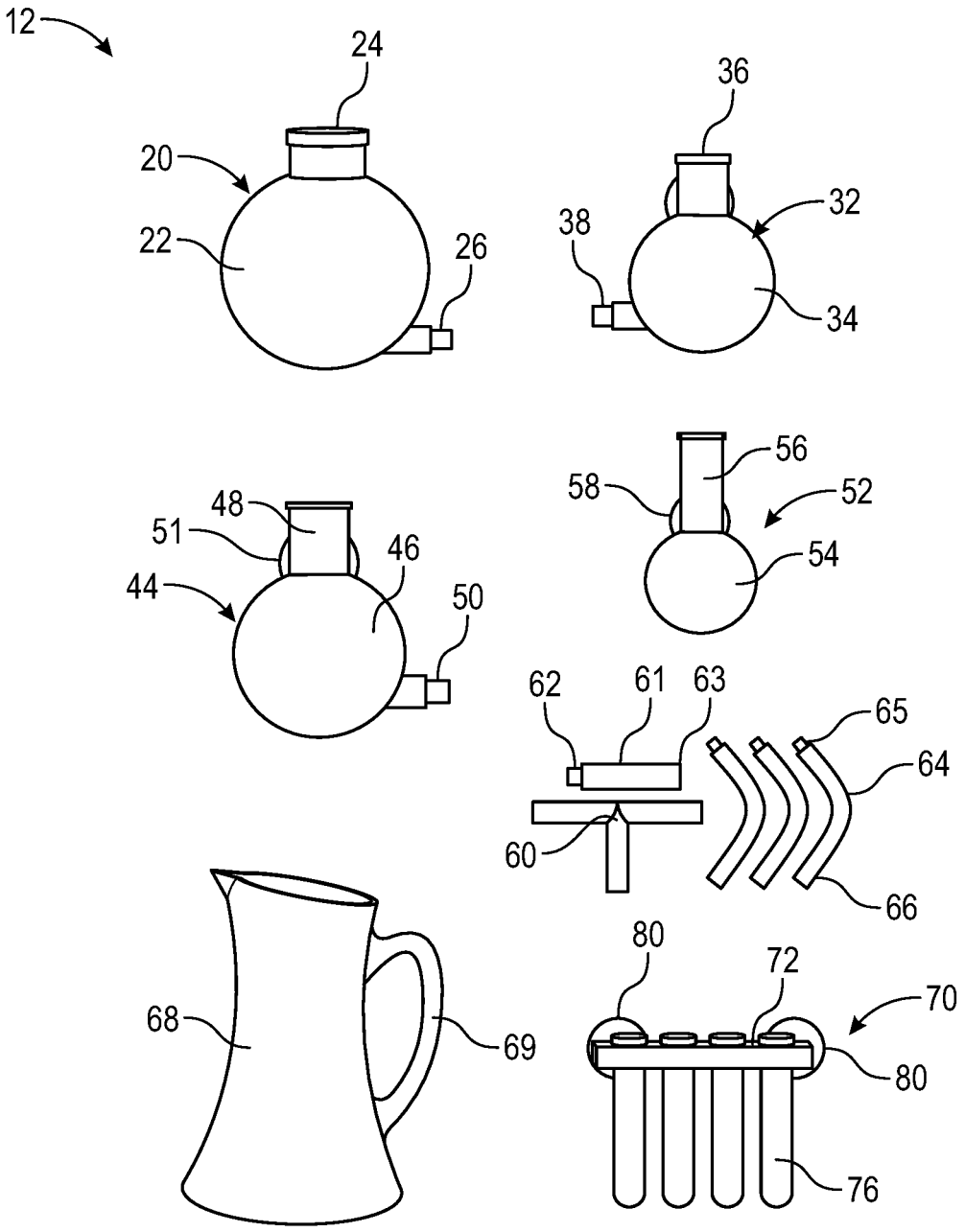
FIG. 2 illustrates the bath toy set including various containers, pipes and tubes, in accordance with one embodiment of the present subject matter.
Figure 3:
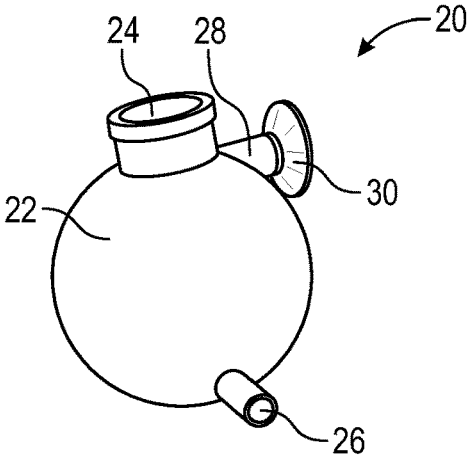
FIG. 3 illustrates a perspective view of a first container, in accordance with one embodiment of the present subject matter.
Figure 4:
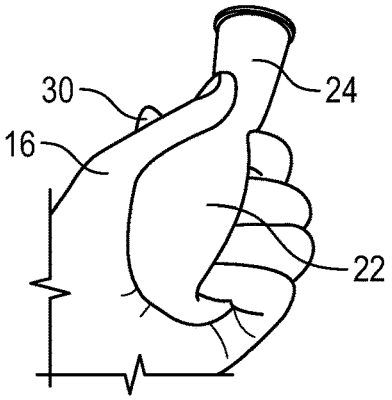
FIG. 4 illustrates a squeezable feature of the first container, in accordance with one embodiment of the present subject matter.

FIG. 2 shows bath toy set 12 including various containers, pipes and tubes, in accordance with one embodiment of the present invention. As can be seen, bath toy set 12 includes a first container 20. FIG. 3 shows a perspective view of first container 20, in accordance with one embodiment of the present invention. First container 20 comes in the shape of a bulb. First container 20 is made of plastic, metal, or any other suitable material. Preferably, first container 20 is made of soft and flexible material such as a silicon material. The soft and flexible material allows users 16 to squeeze first container 20 while playing in water 18 and/or generate bubbles with water 18 and/or soap, as shown in FIG. 4, for example. First container 20 includes a first body 22. First body 22 comes in a substantially circular configuration but may be made in a angular or square configuration as well. First body 22 has a hollow structure (not shown) for storing water 18. First body 22 encompasses a first inlet 24. First inlet 24 extends upwards at the top of first body 22. First inlet 24 receives water 18 and supplies to body 22. First body 22 encompasses a first outlet 26. First outlet 26 extends sideways at the bottom of first body 22. First outlet 26 allows to dispense water 18 from the interior or hollow structure of first body 22. Further, first body 22 includes a first extended section 28. First extended section 28 indicates an arm that extends perpendicularly to first inlet 24 from first body 22. First extended section 28 encompasses a first mounting member 30. First mounting member 30 includes a rubber pad, an adhesive pad, a suction cup, a clamp, or any combination thereof. First mounting member 30 acts as an attachment means that provides suction adhesions to wall 14 and allows to secure first container 20 on wall 14.

Figure 5:
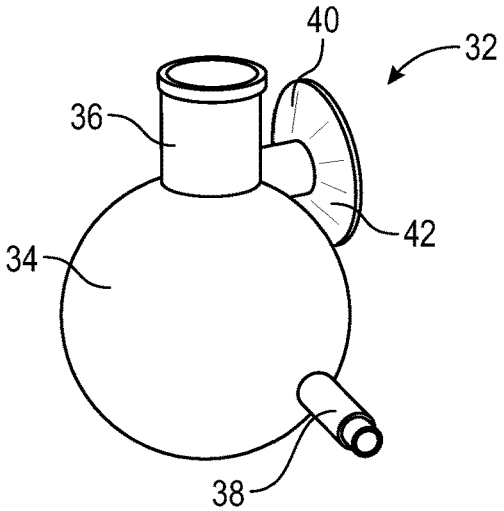
FIG. 5 illustrates a perspective view of a second container, in accordance with one embodiment of the present subject matter.

Bath toy set 12 includes a second container 32. FIG. 5 shows a perspective view of second container 32, in accordance with one embodiment of the present invention. Second container 32 is shown in the shape of a bulb. Second container 32 is made of plastic, metal or any other suitable material. Preferably, second container 32 is made of soft and flexible material such as a silicon material. The soft and flexible material allows users 16 to squeeze second container 32 while playing in water 18 to generate bubbles with water 18 and/or soap. In one example, second container 32 is smaller than first container 20, or vice versa. Second container 32 includes a second body 34. Second body 34 comes in a substantially circular configuration. Second body 34 has a hollow structure (not shown) for storing water 18. Second body 34 encompasses a second inlet 36. Second inlet 36 extends upwards at the top of second body 34. Second inlet 36 receives water 18 and supplies to second body 34. Second body 34 encompasses a second outlet 38. Second outlet 38 extends sideways at the bottom of second body 34. Second outlet 38 allows to dispense water 18 from the interior or hollow structure of second body 34. Further, second body 34 includes a second extended section 40. Second extended section 40 indicates an arm that extends perpendicularly to second inlet 36 from second body 34. Second extended section 40 encompasses a second mounting member 42. Second mounting member 42 includes a rubber pad, an adhesive pad, a suction cup, a clamp, or any combination thereof. Second mounting member 42 acts as an attachment means that provides suction adhesions to wall 14 and allows to secure second container 32 on wall 14.

Further, bath toy set 12 includes a third container 44. Third container 44 is shown with a bulb-shape similar to second container 32. In one example, third container 44 is smaller than first container 20 and second container 32. However, it is possible to provide each of first container 20, second container 32 and third container 44 in the same or different size from one another. Third container 44 includes a third body 46 (similar to second body 34) having a third inlet 48 (similar to second inlet 36) and a third outlet 50 (similar to second outlet 38). Further, third container 44 includes a third extended section (not shown, similar to second extended section 40) connecting a third mounting member 51 (similar to second mounting member 42).

Furthermore, bath toy set 12 includes a fourth container 52. Fourth container 52 is also referred to as an "auxiliary container". In one example, fourth container 52 is smaller than first container 20, second container 32 and third container 44. However, it is possible to provide each of first container 20, second container 32, third container 44 and fourth container 52 in the same or different size from one another. Fourth container 52 includes a fourth body 54 (similar to second body 34) having a fourth inlet or auxiliary inlet 56 (similar to second inlet 36). As can be seen, fourth container 52 does not contain an outlet. Further, fourth container 52 includes a fourth extended section (not shown, similar to second extended section 40) connecting a fourth mounting member or auxiliary mounting member 58 (similar to second mounting member 42).

Bath toy set 12 includes a T-shaped pipe 60. T-shaped pipe 60 allows connecting three pipes (including two outlets of containers) at a time. Further, bath toy set 12 includes a length extending pipe 61. Length extending pipe 61 indicates an intermediary pipe having a step-like opening 62 for inserting into other pipes or outlets of containers at one end and a wider opening 63 at the other end for receiving pipes or outlets of containers. Furthermore, bath toy set 12 includes a plurality of angled connecting pipes 64. Each angled connecting pipe 64 is curved and includes a step-like opening 65 for inserting into other pipes at one end and a wider opening 66 at the other end for receiving pipes or outlets of containers.

Further, bath toy set 12 includes a jar or liquid dispenser 68 with a handle 69. Liquid dispenser 68 helps user 16 to collect water 18 and pour into one of first container 20, second container 32, third container 44 and fourth container 52.

Figure 6:
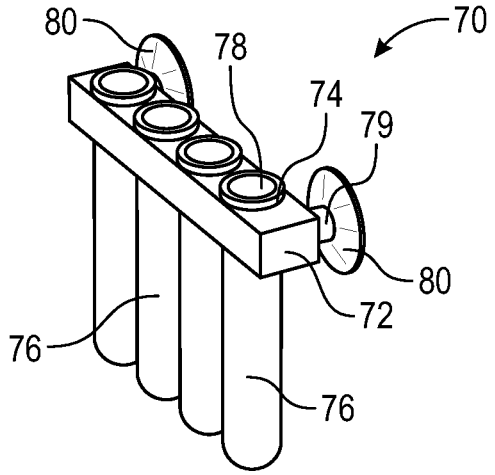
FIG. 6 illustrates a perspective view of a tube assembly, in accordance with one embodiment of the present subject matter.

Bath toy set 12 includes a tube assembly 70. FIG. 6 shows a perspective view of tube assembly 70, in accordance with one embodiment of the present invention. Tube assembly 70 includes a tube holder 72. Tube holder 72 indicates a rectangular section having openings 74 for receiving tubes 76. In one example, one or more openings 74 are provided in tube holder 72 for receiving one or more tubes 76. Tubes 76 come in the shape of test tubes and have tube openings 78 at the top for receiving water 18 and may have holes in the bottom for allowing water to drip out. Further, tube holder 72 includes fifth extended sections 79. Each of fifth extended sections 79 extends from substantially distal ends of tube holder 72. Fifth extended sections 79 include fifth mounting members or tube mounting members 80. Fifth mounting member 80 includes a rubber pad, an adhesive pad, a suction cup, a clamp, or any combination thereof. Fifth mounting member 80 acts as an attachment means that provides suction adhesions to wall 14 and allows to secure tube assembly 70 on wall 14.

Figure 7:
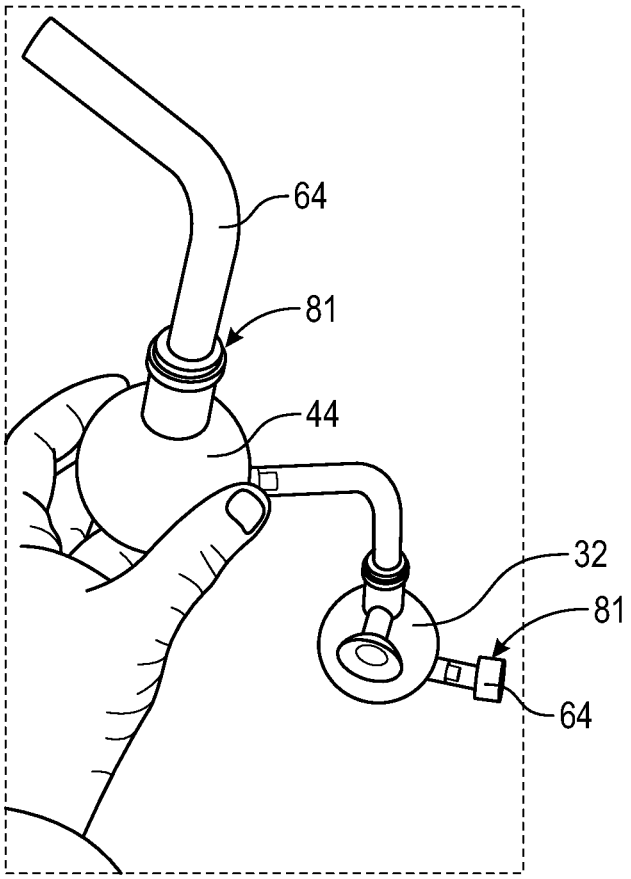
FIG. 7 illustrates a perspective view of connectors, in accordance with exemplary embodiment of the present subject matter.
Figure 8:
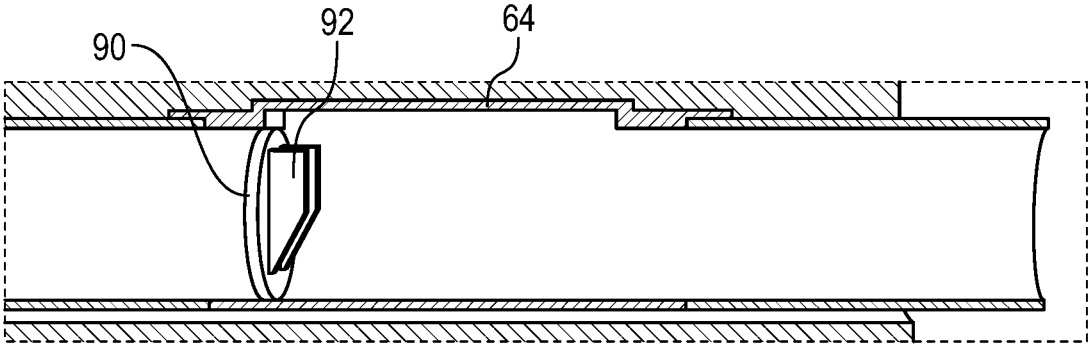
FIGS. 8, 9 and 10 illustrate the feature of the connector having a non-return valve, in accordance with exemplary embodiments of the present subject matter.
Figure 9:
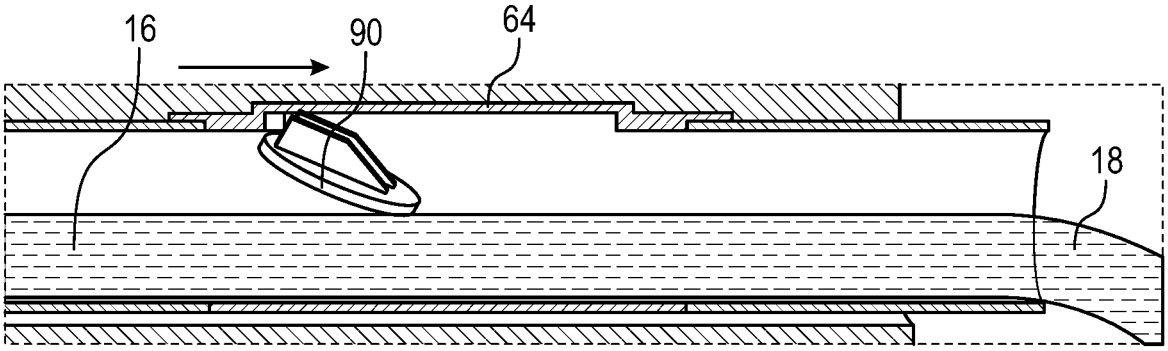
Figure 10:
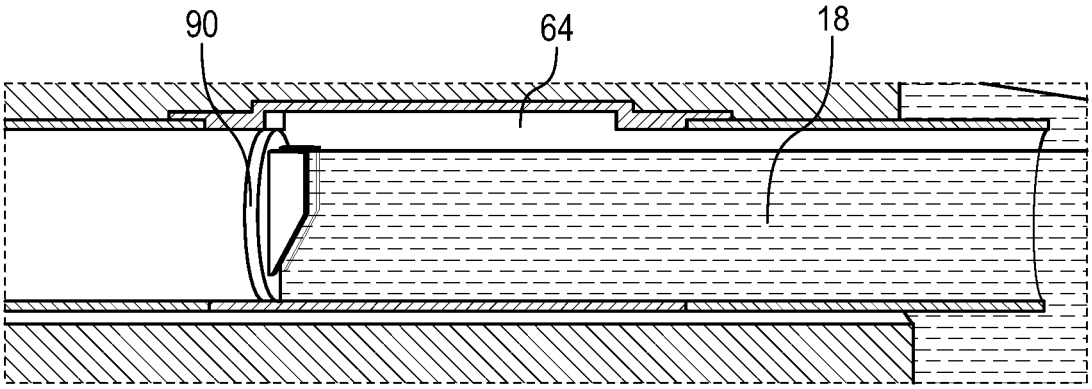
Figure 11:
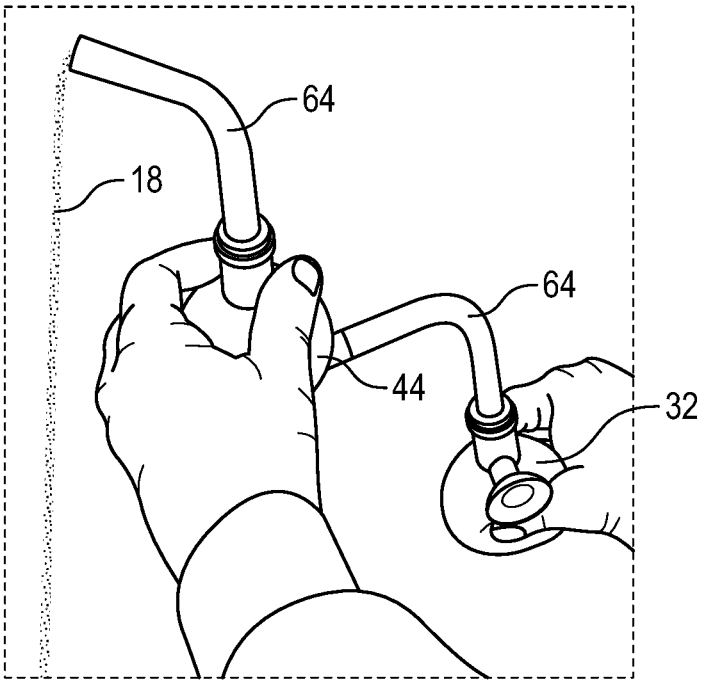
FIG. 11 illustrates the feature of the water being pumped opt as a result of squeezing, in accordance with exemplary embodiment of the present subject matter.

FIG. 7 shows the feature of connector 64 having an end cap or end member 81, in accordance with one exemplary embodiment of the present invention. A person skilled in the art understands that end element 81 can be provided at either end of connector 64. End element 81 of connector 64 includes a non-return valve 90. FIG. 8 shows the feature of connector 64 having non-return valve 90. Non-return valve 90 comes in a relatively vertical configuration. In one example, non-return valve comes as a plate within connector 64 and acts as a one-way stopper allowing the water 18 to flow in one direction. At one end, non-return valve 90 has flaps 92 and other has a flat configuration. Flaps 92 come in a tapered or angles down (downward angled) such that non-return valve 90 lifts open when the water 18 travels towards the flat configuration of non-return valve 90, as shown in FIG. 9. Further, when water 18 flows towards flaps 90, then tapered flaps 90 prevent the non-return valve 90 from lifting up and obstruct the water 18 from flowing further, as shown in FIG. 10. Due to the construction of non-return valve 90, when a container is squeezed, it allows the water 18 to flow against gravity. FIG. 11 shows an exemplary embodiment in which user 16 squeezes second container 32 and causes water 18 to flow out through third container 44 via non-return valve 90 in third container 44. Non-return valve 90 presents a unique effect when user 16 squeezes a container by sending water 18 to flow in the opposite direction of gravity and add fun to bath toy set 12.

Now referring to FIGS. 12, 13, 14 and 15, exemplary set up of bath toy set 12 in various configurations are shown, in accordance with the present invention. A person skilled in the art understands that the configurations shown in the FIGS. 12, 13, 14 and 15 are provided for illustrative purpose only and bath toy set 12 can be arranged in any other configuration without departing from the scope of the present invention. Such modified arrangements fall within scope of the present invention. As specified above, first container 20, second container 32, third container 44, fourth container 52 come in the same or different sizes. As such, they can be arranged in any order i.e., placed parallel, one above the other, at angle from one another, etc. It should be understood that in each of the configurations, first container 20, second container 32, third container 44, fourth container 52 and tube assembly 70 connects to wall 14 with the help of first mounting member 30, second mounting member 42, third mounting member 51, fourth mounting member 58 and fifth mounting members 80, respectively.

Figure 12:
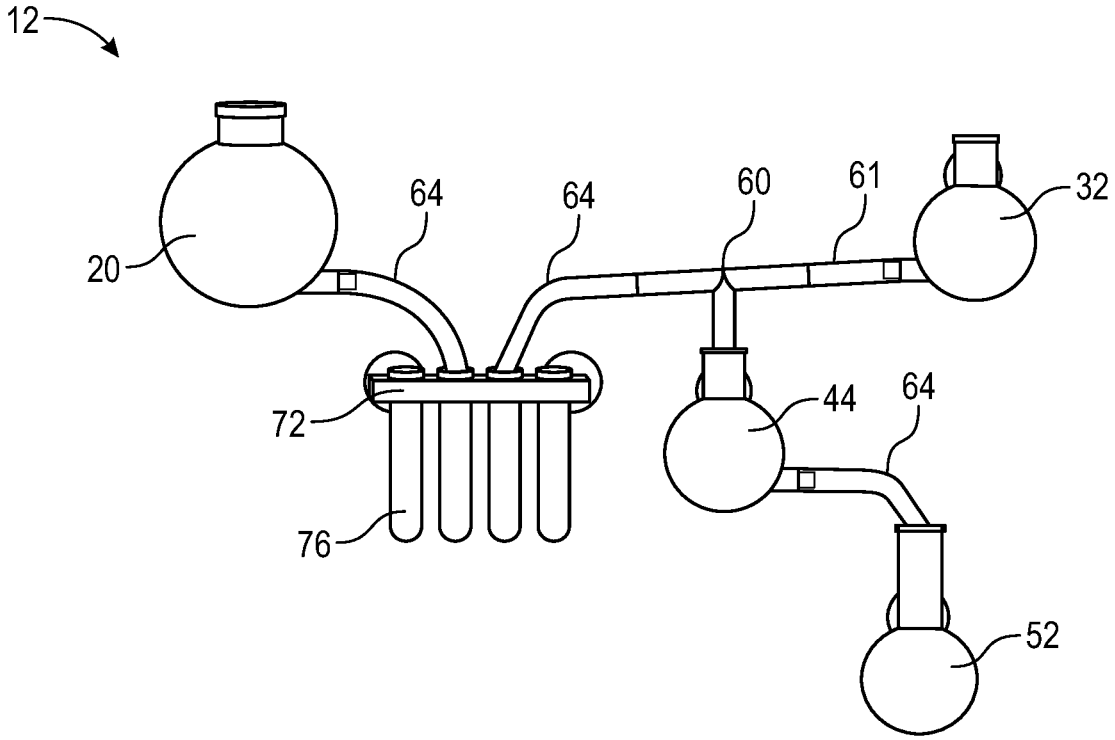
FIGS. 12, 13, 14 and 15 illustrate the bath toy set arranged in various configurations, in accordance with exemplary embodiments of the present subject matter.

Referring to FIG. 12, first container 20 and second container 32 are positioned at the top. First container 20 connects to a tube 76 in tube assembly 70 via an angled connecting pipe 64 at first outlet 26. Further, second container 32 connects to length extending pipe 61 at second outlet 38. Length extending pipe 61 further connects to third container 44 via T-shaped pipe 60 at third inlet 48. T-shaped pipe 60 further connects to another tube 76 in tube assembly 70 via angled connecting pipe 64. Third container 44 connects to fourth container 52 via angled connecting pipe 64. Here, angled connecting pipe 64 connects third outlet 50 and fourth inlet 56. In use, user 16 positions first inlet 24 and second inlet 36 below a tap (not shown) or uses liquid dispenser 68 to pour water 18 into first container 20 and second container 32. Water 18 travels from first container 20 into tube 76 via angled connecting pipe 64. Further, water 18 travels from second container 32 into tube 76 via length extending pipe 61, T-shaped pipe 60 and angled connecting pipe 64. Once water 16 gets filled in tubes 76, water 18 flows out creating bubbles. Concurrently, water 18 travels from second container 32 into third container 44 via length extending pipe 61 and T-shaped pipe 60. Water 18 further flows down from third container 44 into fourth container 52 via connecting pipe 64. Once water 16 gets filled in fourth container 52, water 18 flows out of fourth container 52 creating bubbles.

Figure 13:
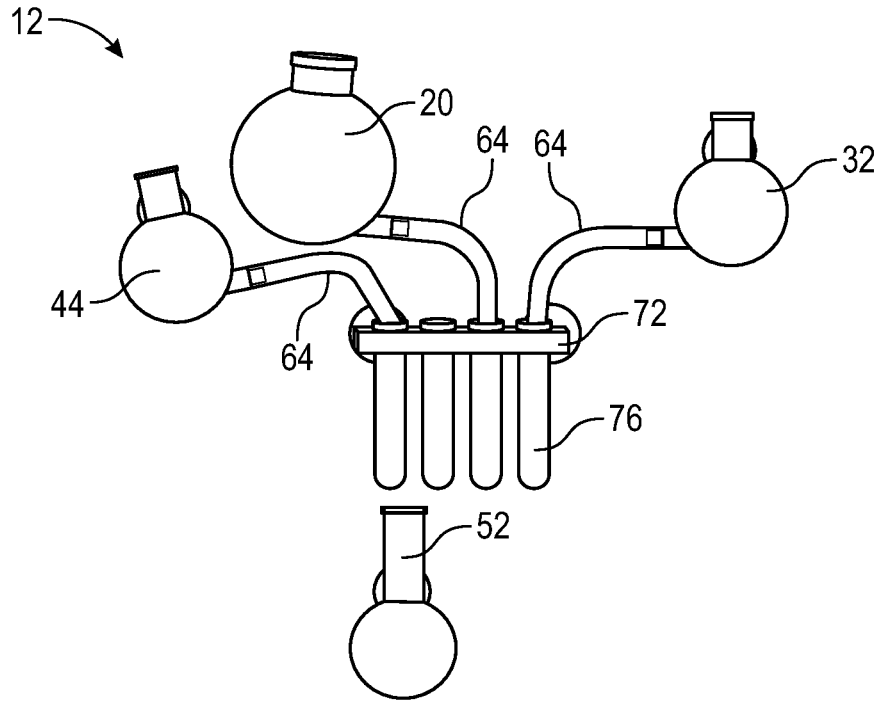

Referring to FIG. 13, first container 20 and second container 32 are positioned at the top, and third container 44 is positioned below first container 20. Here, each of first container 20, second container 32 and third container 44 connects to a tube 76 in tube assembly 70 via angled connecting pipe 64 at first outlet 26, second outlet 38 and third outlet 50, respectively. In the present configuration, fourth container 52 is aligned underneath tube assembly 70. When water 18 is poured into one or more of first container 20, second container 32 and third container 44, water 18 fills in tubes 76 and overflows. The overflowing water 18 is made to collect in fourth container 52.

Figure 14:
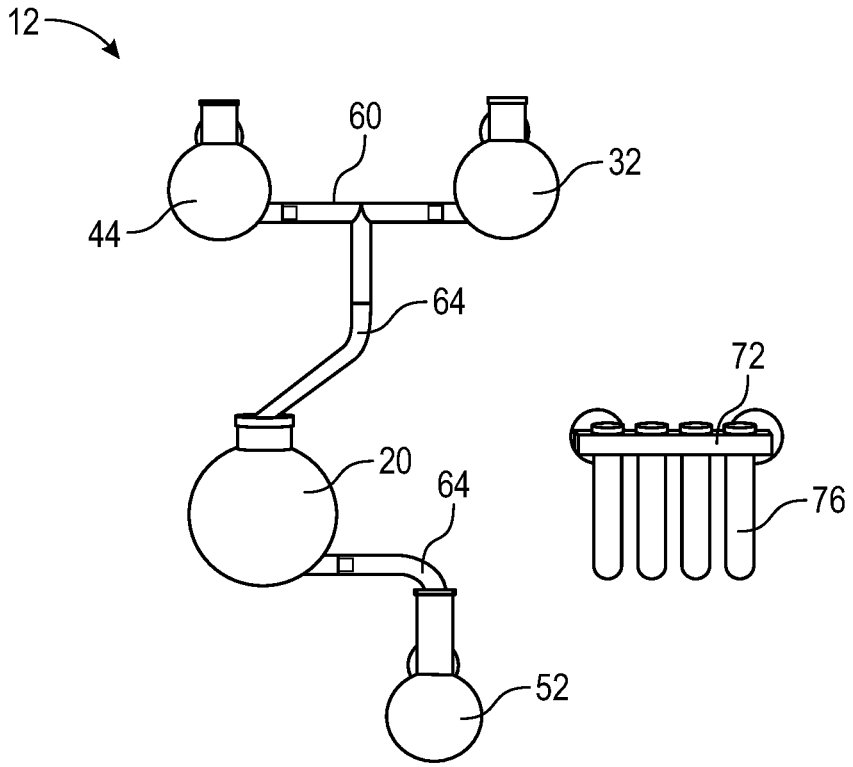

Referring to FIG. 14, second container 32 and third container 44 are positioned at the top. T-shaped pipe 60 connects at second outlet 38 and third outlet 50. In the present configuration, first container 20 is poisoned underneath second container 32 and third container 44. T-shaped pipe 60 connects to first inlet 24 via angled connecting pipe 64. Further, fourth container 52 positions underneath first container 20. Here, first container 20 connects to fourth container 52 via angled connecting pipe 64. In this configuration, tube assembly 70 positions adjacent to first container 20. In use, user 16 positions second inlet 36 and/or third inlet 48 below a tap (not shown) or uses liquid dispenser 68 to pour water 18 into second inlet 36 and/or third inlet 48. Water 18 travels from second container 32 and/or third container 44 into first container 20 due to gravity via angled connecting pipe 64. Subsequently, water 18 flows into fourth container 52 due to gravity via angled connecting pipe 64.

Figure 15:
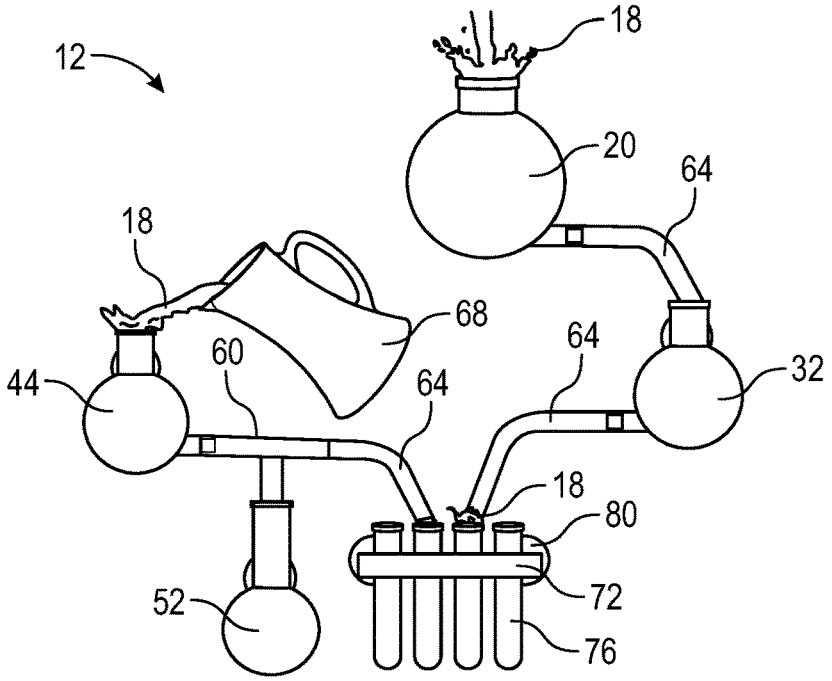

Referring to FIG. 15, first container 20 is positioned at the top, and second container 32 and third container 44 are positioned underneath first container 20 in substantially parallel to each other. Further, tube assembly 70 is positioned underneath second container 32 and third container 44. Furthermore, fourth container 52 is positioned adjacent to tube assembly 70. Here, first container 20 connects to second container 32 via angled connecting pipe 64 at first outlet 26. Further, second container 32 connects to tube 76 in tube assembly 70 via an angled connecting pipe 64. Third container 44 connects to T-shaped pipe 60. T-shaped pipe 60 connects to fourth container 52, and tube 76 in tube assembly 70 via an angled connecting pipe 64. In use, user 16 aligns first inlet 24 with the tap (not shown) and pours water 18 from liquid dispenser 68 into third container 44. Here, water 18 flows from first container 20 into second container 32 and then into tube 76. Further, water 18 flows from third container 44 into tube 76 and fourth container 52 via T-shaped pipe 60.

Figure 16:
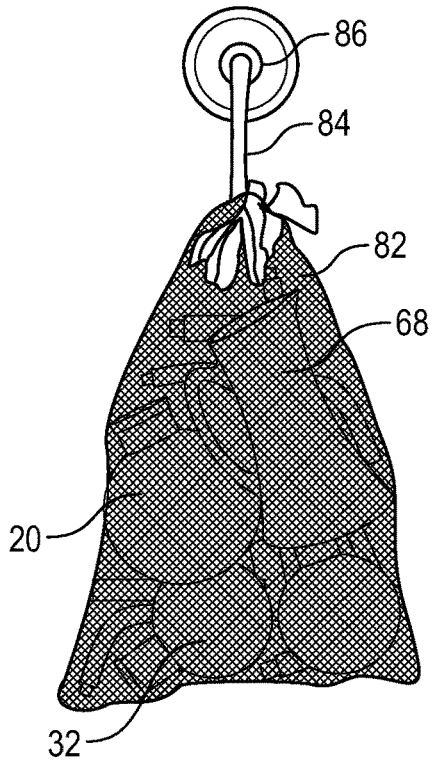
FIG. 16 illustrates a mesh container storing the bath toy set when not in use, in accordance with one embodiment of the present subject matter.

When not in use, user 16 uninstalls each of first mounting member 30, second mounting member 42, third mounting member 51, fourth mounting member 58 and fifth mounting members 80 from wall 14 and places first container 20, second container 32, third container 44, fourth container 52 and tube assembly 70 in a mesh container 82, as shown in FIG. 16. Mesh container 82 indicates a carry bag having holes. Here, mesh container 82 acts as a storage unit for storing first container 20, second container 32, third container 44, fourth container 52 and tube assembly 70. Mesh container 82 is made of suitable material to withstand the weight of bath toy set 12. In one example, user 16 drains water 18 contained in first container 20, second container 32, third container 44, fourth container 52 and tube assembly 70 prior to placing them in mesh container 82. Mesh container 82 includes a connector 84 connecting to a sixth mounting member or mesh mounting member 86. Here, sixth mounting member 86 includes a rubber pad, an adhesive pad, a suction cup, a clamp, or any combination thereof. Mesh container 82 receives first container 20, second container 32, third container 44, fourth container 52 and tube assembly 70 and connects to wall 14 with the help of sixth mounting member 86. In one example, mesh container 82 allows water to drain from first container 20, second container 32, third container 44, fourth container 52 and tube assembly 70.

Based on the above, it is evident that the presently disclosed bath toy set presents multiple containers that can be positioned in various configurations over a wall with the help of mounting members. Further, the bath toy set provides various connecting pipes such as the T-shaped pipe, the length extending pipe and the angled connecting pipes to connect the containers in various configurations. The bath toy set allows the users or children to modify the arrangement to make bath time more fun. When not in need, the users can uninstall and store the multiple containers, the T-shaped pipe, the length extending pipe and the angled connecting pipes in the mesh container.

A person skilled in the art appreciates that the bath toy set may come in a variety of shapes and sizes depending on the need and comfort of the user. Further, many changes in the design and placement of components may take place without deviating from the scope of the presently disclosed bath toy set.

In the above description, numerous specific details are set forth such as examples of some embodiments, specific components, devices, methods, in order to provide a thorough understanding of embodiments of the present subject matter. It will be apparent to a person of ordinary skill in the art that these specific details need not be employed, and should not be construed to limit the scope of the subject matter.

In the development of any actual implementation, numerous implementation-specific decisions must be made to achieve the developer's specific goals, such as compliance with system-related and business-related constraints. Such a development effort might be complex and time-consuming, but may nevertheless be a routine undertaking of design, fabrication, and manufacture for those of ordinary skill. Hence as various changes could be made in the above constructions without departing from the scope of the invention, it is intended that all matter contained in the above description or shown in the accompanying drawings shall be interpreted as illustrative and not in a limiting sense.

The foregoing description of embodiments is provided to enable any person skilled in the art to make and use the invention. Various modifications to these embodiments will be readily apparent to those skilled in the art, and the novel principles and invention disclosed herein may be applied to other embodiments without the use of the innovative faculty. It is contemplated that additional embodiments are within the spirit and true scope of the disclosed invention.

What is claimed is:

1. A bath toy set, comprising:

a plurality of soft and squeezable containers, each container comprising a body, an inlet and an outlet, wherein said inlet extends from at or near a top of said body, wherein said outlet extends outward at or near a bottom of said body, and a plurality of connecting pipes; wherein at least one of said plurality of connecting pipes connects to said outlet of a container of said plurality of containers, and said inlet of a second container of said plurality of containers, and wherein said one or more containers of said plurality of containers receives water through said inlet and allows the water to flow via said outlet and into said second container via said one or more connecting pipes.

2. The bath toy set of claim 1, wherein each container further comprises a mounting member for connecting said container to a wall; and wherein said mounting member comprises one of a rubber pad, an adhesive pad, a suction cup, a clamp, and any combination thereof.

3. The bath toy set of claim 1, further comprises a non-return valve in at least one of said plurality of connecting pipes, wherein said non-return valve allows the water to move in the opposite direction of gravity when squeezing said container of said one or more containers.

4. The bath toy set of claim 1, further comprises a T-shaped pipe, wherein said T-shaped pipe connects to said outlet of a container of said plurality of containers, and said inlet of a container of said plurality of containers, and wherein said one or more containers of said plurality of containers receive water through said inlet and allow the water to flow down via said outlet and into said container or said plurality of tubes positioned lower, via said T-shaped pipe.

5. The bath toy set of claim 1, further comprises a tube assembly consisting of a tube holder holding a plurality of tubes, wherein said tube holder includes a tube mounting member for connecting said tube holder to said wall, wherein said tube assembly positions lower than one or more containers of said plurality of containers, and wherein said one or more containers of said plurality of containers placed at the top receive water through said inlet and allow the water to flow down via said outlet and into said container or said plurality of tubes positioned underneath via said T-shaped pipe or said one or more connecting pipes of said plurality of connecting pipes.

6. The bath toy set of claim 1, further comprises a card showing a possible configuration with the containers and the pipes.

7. The bath toy set of claim 1, further comprises an auxiliary container, wherein said auxiliary container comprises an auxiliary inlet, and wherein said auxiliary inlet connects to one of said T-shaped pipes or a connecting pipe of said plurality of connecting pipes to receive water into said auxiliary container.

8. The bath toy set of claim 1, wherein said auxiliary container comprises an auxiliary mounting member for connecting said auxiliary container to said wall, and wherein said auxiliary mounting member comprises one of a rubber pad, an adhesive pad, a suction cup, a clamp, and any combination thereof, and wherein said auxiliary member can be rotated to alternatively hold water or pour water while connected to said wall.

9. The bath toy set of claim 1, further comprises a mesh container, wherein said mesh container stores said plurality of containers, said T-shaped pipe, said plurality of connecting pipes, and said tube assembly when not in use.

10. The bath toy set of claim 1, wherein said mesh container comprises a mesh mounting member for connecting said mesh container to said wall, and wherein said mesh mounting member comprises one of a rubber pad, an adhesive pad, a suction cup, a clamp, and any combination thereof.

11. A bath toy set, comprising:

a plurality of soft and squeezable containers, each container comprising a body, an inlet and an outlet, wherein said inlet extends from at or near a top of said body, wherein said outlet extends outward near a bottom of said body, and wherein each container further comprises a mounting member for connecting said container to a wall;

a T-shaped pipe;

a connecting pipe; and a tube assembly comprising a tube holder holding a plurality of tubes, wherein said tube holder comprises a tube mounting member for connecting said tube holder to said wall, wherein said plurality of containers position in parallel or over one another at an angle, wherein said tube assembly positions underneath one or more containers of said plurality of containers, wherein one of said T-shaped pipe and said one connecting pipe interchangeably connects said outlet of a container of said plurality of containers positioned at the top, and said inlet of a container of said plurality of containers or a tube of said plurality of tubes, and wherein said one or more containers of said plurality of containers placed at the top receive water through said inlet and allow the water to flow down via said outlet and into said container or said plurality of tubes positioned underneath via said T-shaped pipe or said one or more connecting pipes of said plurality of connecting pipes.

12. A method of providing a bath toy set, the method comprising the steps of:

providing a plurality of soft and squeezable containers, each container comprising a body, an inlet and an outlet, said inlet extending from a top of said body, said outlet extending sideways at a bottom of said body;

providing a mounting member for each of said plurality of containers for connecting said containers to a wall;

providing a plurality of connecting pipes;

connecting one or more connecting pipes of said plurality of connecting pipes to said outlet of a container of said plurality of containers, and said inlet of a container of said plurality of containers; and placing said one or more containers of said plurality of containers so as to receive water through said inlet and allowing the water to flow down via said outlet and into said container positioned underneath via said one or more connecting pipes of said plurality of connecting pipes.

13. The method of providing a bath toy set of claim 12, wherein each container further comprises a mounting member for connecting said container to a wall; and wherein said mounting member comprises one of a rubber pad, an adhesive pad, a suction cup, a clamp, and any combination thereof.

14. The method of providing a bath toy set of claim 12, further comprises a non-return valve in at least one of said plurality of connecting pipes, wherein said non-return valve allows the water to move in the opposite direction of gravity when squeezing said container of said one or more containers.

15. The method of providing a bath toy set of claim 12, further comprises a card showing a possible configuration with the containers and the pipes.

16. The method of providing a bath toy set of claim 12, further comprises a mesh container, wherein said mesh container stores said plurality of containers, said T-shaped pipe, said plurality of connecting pipes, and said tube assembly when not in use and wherein said mesh container comprises a mesh mounting member for connecting said mesh container to said wall, and wherein said mesh mounting member comprises one of a rubber pad, an adhesive pad, a suction cup, a clamp, and any combination thereof.

17. The method of providing a bath toy set of claim 12, further comprises a T-shaped pipe, wherein said T-shaped pipe can connect a combination of outlets of a container of said plurality of containers, inlets of a container of said plurality of containers.

18. The method of providing a bath toy set of claim 12, further comprises a tube assembly consisting of a tube holder holding a plurality of tubes, wherein said tube holder includes a tube mounting member for connecting said tube holder to said wall, wherein said tube assembly positions lower than one or more containers of said plurality of containers, and wherein said one or more containers of said plurality of containers placed at the top receive water through said inlet and allow the water to flow down via said outlet and into said container or said plurality of tubes positioned underneath via said T-shaped pipe or said one or more connecting pipes of said plurality of connecting pipes.

19. The method of providing a bath toy set of claim 12, further comprises an auxiliary container, wherein said auxiliary container comprises an auxiliary inlet, and wherein said auxiliary inlet connects to one of said T-shaped pipes or a connecting pipe of said plurality of connecting pipes to receive water into said auxiliary container.

20. The method of providing a bath toy set of claim 12, wherein said auxiliary container comprises an auxiliary mounting member for connecting said auxiliary container to said wall, and wherein said auxiliary mounting member comprises one of a rubber pad, an adhesive pad, a suction cup, a clamp, and any combination thereof, and wherein said auxiliary member can be rotated to alternatively hold water or pour water while connected to said wall.

* * * * *